US011623847B2

(12) United States Patent
Varnava

(10) Patent No.: US 11,623,847 B2
(45) Date of Patent: Apr. 11, 2023

(54) SLING

(71) Applicant: Cortland Company, Inc., Cortland, NY (US)

(72) Inventor: Thanasis Varnava, Houston, TX (US)

(73) Assignee: Cortland Company, Inc., Cortland, NY (US)

( * ) Notice: Subject to any disclaimer, the term of this patent is extended or adjusted under 35 U.S.C. 154(b) by 556 days.

(21) Appl. No.: 16/777,093

(22) Filed: Jan. 30, 2020

(65) Prior Publication Data

US 2021/0238013 A1 Aug. 5, 2021

(51) Int. Cl.

| | |
|---|---|
| ***B66C 1/18*** | (2006.01) |
| ***D07B 1/00*** | (2006.01) |
| ***D07B 5/00*** | (2006.01) |
| ***B66C 1/12*** | (2006.01) |

(52) U.S. Cl.

CPC ..... *B66C 1/18* (2013.01); *B66C 1/12* (2013.01); *D07B 1/00* (2013.01); *D07B 5/006* (2015.07); *D07B 2201/1036* (2013.01); *D07B 2205/2014* (2013.01); *D07B 2501/2015* (2013.01)

(58) Field of Classification Search

CPC .... B66C 1/18; B66C 1/12; D07B 1/00; D07B 1/12; D07B 1/185; D07B 1/18; D07B 5/006; D07B 2201/1036; D07B 2201/1096; D07B 2205/2014; D07B 2205/2042; D07B 2205/205; D07B 2205/2064; D07B 2501/2015

See application file for complete search history.

(56) References Cited

U.S. PATENT DOCUMENTS

| | | | | |
|---|---|---|---|---|
| 2,299,568 | A * | 10/1942 | Dickey | D07B 1/18 87/8 |
| 3,854,767 | A | 12/1974 | Burnett | |
| 4,036,101 | A | 7/1977 | Burnett | |
| 5,561,973 | A * | 10/1996 | St. Germain | D07B 1/185 57/22 |
| 7,823,496 | B2 * | 11/2010 | Bosman | D07B 1/025 87/9 |
| 10,377,607 | B2 * | 8/2019 | Mozsgai | D07B 7/165 |

(Continued)

FOREIGN PATENT DOCUMENTS

| | | | |
|---|---|---|---|
| CN | 208776190 | U | 4/2019 |
| WO | 2017178484 | A1 | 10/2017 |

OTHER PUBLICATIONS

International Search Report with Written Opinion for related Application No. PCT/US2021/015422 dated May 12, 2021 (8 Pages).

*Primary Examiner* — Stephen A Vu
(74) *Attorney, Agent, or Firm* — Andrus Intellectual Property Law, LLP

(57) ABSTRACT

The disclosure provides a sling including a sleeve, a first eye formed by a first splice, and a second eye formed by a second splice. The sleeve includes braided strands and has a first end portion, a second end portion, and an intermediate portion between. The sleeve also defines a hollow inner volume. The first splice is made by the first end portion extending into and along part of the hollow inner volume proximate the first eye. The second splice is made by the second end portion extending into and along part of the hollow inner volume proximate the second eye. A hollow load bearing portion is defined in the intermediate portion between the first splice and the second splice.

16 Claims, 7 Drawing Sheets

(56) References Cited

U.S. PATENT DOCUMENTS

| | | | | |
|---|---|---|---|---|
| 2011/0169285 | A1 | 7/2011 | Germain | |
| 2014/0157973 | A1* | 6/2014 | Plante | D04C 1/12 87/8 |
| 2014/0230634 | A1* | 8/2014 | Nakai | D04C 1/06 87/8 |
| 2020/0156790 | A1* | 5/2020 | von Flotow | B64C 39/024 |

* cited by examiner

SLING

FIELD

The present disclosure generally relates to slings and, more particularly, to slings with hollow load bearing portions.

SUMMARY

In recent years, braided synthetic ropes have replaced steel cables in many applications because of, for example, relatively low weight, high strength, flexibility, resistance to corrosion, and electrically insulating properties. These applications can include, among others, use with lifting apparatus, like cranes, to lift heavy loads for transport or installation purposes.

One aspect of the disclosure provides a sling including a sleeve, a first eye formed by a first splice, and a second eye formed by a second splice. The sleeve includes braided strands and has a first end portion, a second end portion, and an intermediate portion therebetween. The sleeve also defines a hollow inner volume. The first splice is made by the first end portion extending into and along part of the hollow inner volume proximate the first eye. The second splice is made by the second end portion extending into and along part of the hollow inner volume proximate the second eye. A hollow load bearing portion is defined in the intermediate portion between the first splice and the second splice.

Another aspect of the disclosure provides a method for manufacturing a sling including forming a hollow sleeve, forming a first eye, and forming a second eye. The hollow sleeve includes braided strands and has a first end portion, a second end portion, and an intermediate portion therebetween. The hollow sleeve defines a hollow inner volume. The first eye is formed by splicing the first end portion to extend into and along part of the hollow inner volume. The second eye is formed by splicing the second end portion to extend into and along part of the hollow inner volume. A hollow load bearing portion is formed in the intermediate portion between the first eye and the second eye.

Another aspect of the disclosure provides a method for using a sling including providing a sling, supporting a load to be lifted, attaching a first eye to a lifting apparatus, attaching a second eye to the lifting apparatus, and lifting the load with the sling. The sling includes a sleeve that includes braided strands. The sleeve has a first end portion, a second end portion, and an intermediate portion therebetween. The sleeve defines a hollow inner volume. The first eye is formed by a first splice with the first end portion extending into and along part of the hollow inner volume proximate the first eye. The second eye is formed by a second splice with the second end portion extending into and along part of the hollow inner volume proximate the second eye. A hollow load bearing portion is defined in the intermediate portion between the first and second splice. The load bearing portion supports the load and flattens on a surface of the load.

Other aspects of the disclosure may become apparent by consideration of the detailed description, claims and accompanying drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted", "connected", "supported", and "coupled" and variations thereof are used broadly and encompass both direct and indirect mountings, connections, supports, and couplings.

Relative terminology, such as, for example, "about", "approximately", "substantially", etc., used in connection with a quantity or condition would be understood by those of ordinary skill to be inclusive of the stated value and has the meaning dictated by the context (for example, the term includes at least the degree of error associated with the measurement of, tolerances (e.g., manufacturing, assembly, use, etc.) associated with the particular value, etc.). Such terminology should also be considered as disclosing the range defined by the absolute values of the two endpoints. For example, the expression "from about 2 to about 4" also discloses the range "from 2 to 4". The relative terminology may refer to plus or minus a percentage (e.g., 1%, 5%, 10% or more) of an indicated value.

Also, the functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not listed.

Braided synthetic ropes are used in many applications, including lifting heaving loads. Currently-used braided synthetic ropes, however, may apply more pressure than desired, which can damage fragile loads. Exemplary slings disclosed and contemplated herein may decrease the pressure applied to a load while maintaining the lifting capacity. In some aspects, the pressure may decrease because of an increased contact area between the sling and the load.

Figure 1:
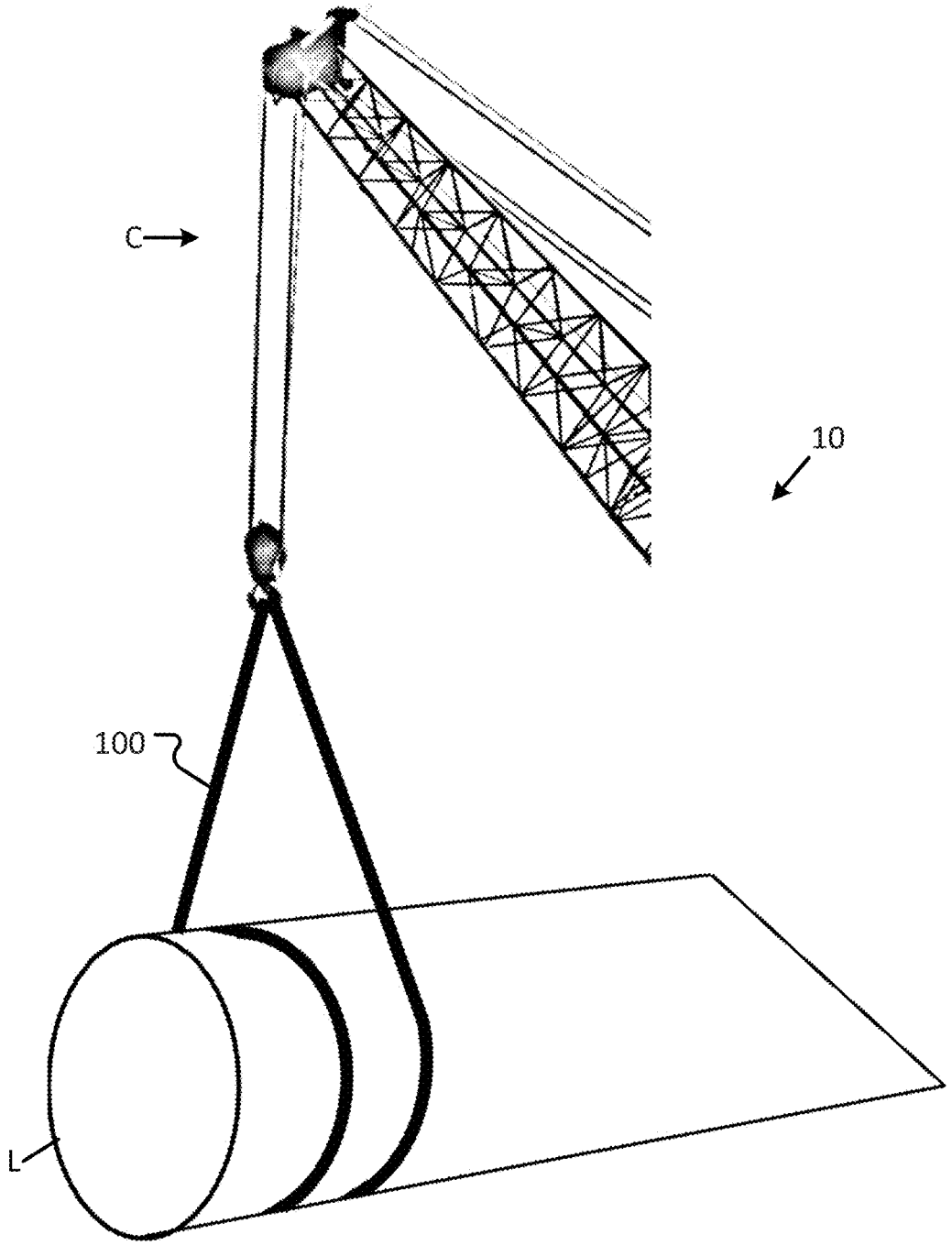
FIG. 1 is a schematic view of an environment for using an exemplary sling.

FIG. 1 shows an example environment 10 for using an exemplary sling 100. As shown, the sling 100 is coupled to a lifting apparatus C and to a load L. The sling 100 can enable the lifting apparatus C (e.g., a crane C or other lifting apparatus) to lift and rotate the load L. The load L can take many forms, and exemplary loads L include wind turbine blades, delicate machinery, work pieces with high levels of finishing, etc.

In the example implementation shown in FIG. 1, the sling 100 wraps around the load L, supporting and constraining the weight. The sling 100 also connects to the crane C, allowing the crane C to move the load L. The crane C can raise the load L to an installation height so that technicians can complete an installation process, lower the load L from an installation height for removal, lift and lower the load L to facilitate transport, etc.

Figure 2:
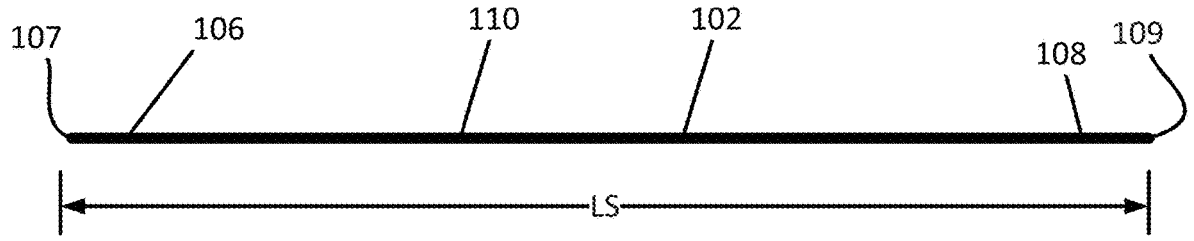
FIG. 2 is a schematic top view of a sleeve used to make a sling.
Figure 3:
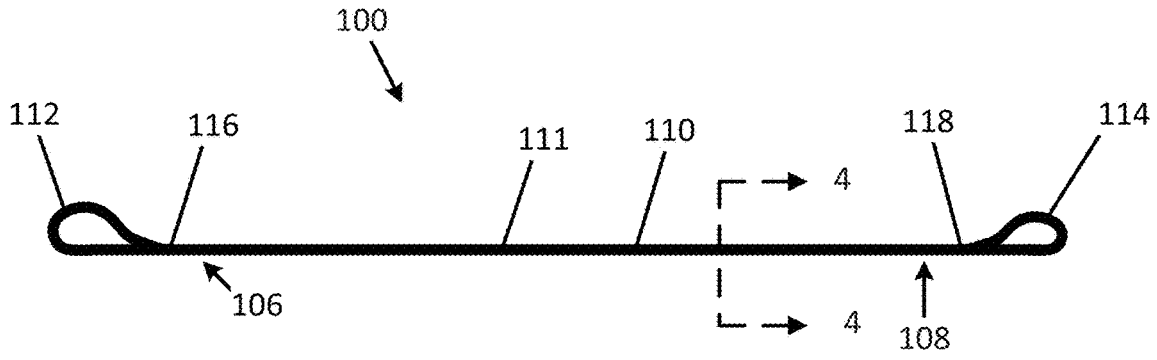
FIG. 3 is a schematic top view of a sling.
Figure 4:
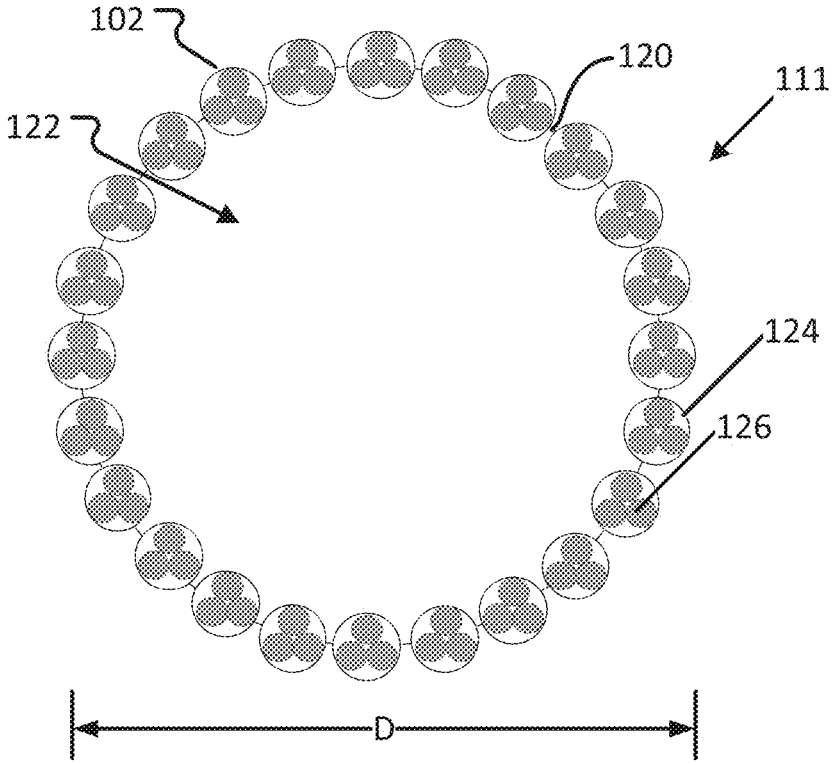
FIG. 4 is a schematic cross sectional view of the sling of FIG. 3 through the section line 4-4 in FIG. 3 while in an unloaded state.

FIG. 2 shows a schematic top view of a sleeve 102, which is a precursor to the illustrated sling 100. FIG. 3 shows a schematic top view of example sling 100 once it has been formed. FIG. 4 shows a schematic cross sectional view along line 4-4 of FIG. 3.

The illustrated sling 100 is made from the sleeve 102 having a sleeve length LS, a first end portion 106, a second end portion 108, and an intermediate portion 110 between first end portion 106 and second end portion 108. The sling 100 includes eyes 112, 114 formed by respective splices 116, 118. The illustrated sling 100 is made of synthetic materials, such as fibers of high modulus polyethylene (HMPE). The illustrated sleeve 102 is made of braided strands 120, has a diameter D, and defines a hollow inner volume 122.

The first end portion 106 extends from one end 107 of the sleeve 102 in towards the center of the sleeve 102, while the second end portion 108 extends from the opposite end 109 in towards the center. The intermediate portion 110 extends between the first end portion 106 and the second end portion 108.

A load bearing portion 111 of the sling 100 is defined between the first splice 116 and the second splice 118. The load bearing portion 111 can interface with the load L. During typical operation, the load bearing portion 111 wraps around the load L. The intermediate portion 110 connects the load bearing portion 111 with the first end portion 106 and the second end portion 108 allowing the load to be supported on the crane C by the first eye 112 and second eye 114.

The first eye 112 serves as a first connection point between the sling 100 and a lifting apparatus C and is created by the first splice 116. In some embodiments, the first splice 116 may be a locking Brummel splice; however, in other embodiments, other appropriate splices may be used. Generally, the first splice 116 is formed by the first end 107 of the sleeve 102 threading into the hollow inner volume 122 so that the first end portion 106 extends in the hollow inner volume 122 along part of the intermediate portion 110.

The second eye 114 serves as a second connection point between the sling 100 and the crane C and is created by the second splice 118. In some embodiments, the second splice 118 may be a locking Brummel splice; however, in other embodiments other appropriate splices may be used. Generally, the second splice 118 is formed by the second end 109 of the sleeve 102 threading into the hollow inner volume 122 so that the second end portion 106 extends in the hollow inner volume 122 along part of the intermediate portion 110. In some instances, end portion 106 or end portion 108 used to form the corresponding splice 116 or 118 has a length as short as 21 times the diameter D of the sleeve 102. In some instances, the end portion 106 or end portion 108 used to form the corresponding splice 116 or 118 has a length as long as 63 times the diameter D of the sleeve 102.

FIG. 4 is a schematic cross-section of the sling 100 through the load bearing portion 111 in an unloaded state. The braided strands 120 surround and define the hollow inner volume 122. The diameter D of the load bearing portion 111 of the sling 100 can be measured in the unloaded state. In various implementations, sleeve 102 can have a diameter D between 0.5 inches and 10 inches. For instance, sleeve 102 can have a diameter D of 0.5 inch; 1 inch; 1.5 inch; 2 inches; 3 inches; 4 inches; 5 inches; 6 inches; 7 inches; 8 inches; 9 inches; or 10 inches.

In some implementations, the braided strands 120 are formed from HMPE fibers. In other instances, the braided strands 120 can be formed from other high performance fibers, for example liquid crystal polymers, aramid fibers, etc. The fibers can be coated in polyurethane to protect them from wear. In some instances, the sleeve 102 can have a total denier of high modulus polyethylene (HMPE) between 460,800 and 24,576,000. In some implementations the sleeve 102 has a total denier of HMPE of about 35,328,000.

The braided strands 120 can be provided in various configurations. As shown, braided strands 120 are in a 24×3 configuration, meaning the sleeve 102 is composed of twenty-four braids 124 with each of the twenty-four braids 124 being formed of three strands 126. In other implementations, the braided strands 120 can be provided in different configurations, such as, for example, 12×3, 16×3, 20×2, 20×3, 24×1, 24×2, 32×1, 32×2, 32×3, 48×1, 48×2, 48×3, etc.

Figure 5:
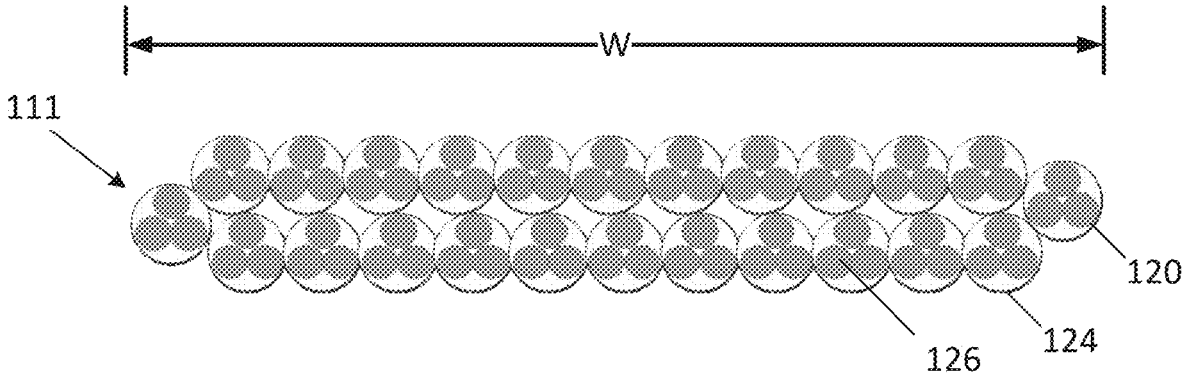
FIG. 5 is a schematic cross sectional view of the sling of FIG. 3 through the section line 4-4 in FIG. 3 while under loading conditions.

FIG. 5 depicts a schematic cross-section of the sling 100 through the load bearing portion 111 in a loaded state. It will be appreciated that the actual cross-sectional appearance of the sling 100 can vary from that shown in FIG. 5 when the sling 100 is under load and can depend on the shape of the load being lifted.

Under load, the hollow inner volume 122 allows the braided strands 120 to compress, creating a width W of the load bearing portion 111 of the sling 100. In comparison (see FIGS. 4-5), the width W of the load bearing portion 111 of the sling 100 in a loaded state is greater than its diameter D in an unloaded state. In some instances the width W is greater than the diameter D by a factor of between 1.5 and 2.

Figure 6:
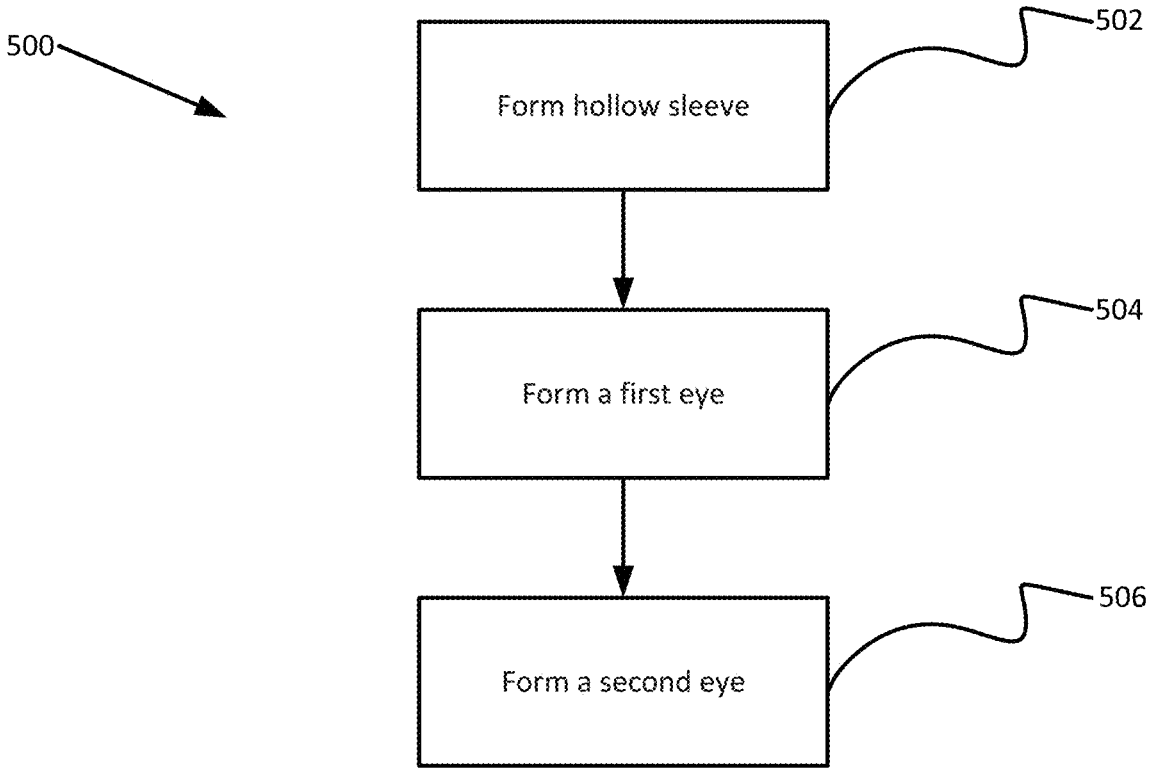
FIG. 6 is an example method for creating a sling as shown in FIG. 3.

FIG. 6 shows an example method 500 for manufacturing a sling. Typically, execution of the method 500 results in generation of a sling including one or more aspects described above with reference to the sling 100. However, other embodiments can include more or fewer operations.

The method 500 begins with forming a hollow sleeve (operation 502). As described in the example above, the hollow sleeve includes braided strands and has a first end portion, a second end portion, and an intermediate portion therebetween. The hollow sleeve is formed such that it defines a hollow inner volume. In some implementations, a hollow sleeve may be provided rather than being formed.

Next, a first eye is formed (operation 504). As described in the example above, forming the first eye (operation 504) includes splicing the first end portion such that the first end portion extends into and along part of the hollow inner volume of the hollow sleeve. In some implementations, forming the first eye (operation 504) includes using a Brummel splice technique.

A second eye is also formed (operation 506). As described in the example above, forming the second eye (operation 506) includes splicing the second end portion such that the second end portion extends into and along part of the hollow inner volume of the hollow sleeve. In some implementations, forming the second eye (operation 506) includes using a Brummel splice technique.

Figure 7:
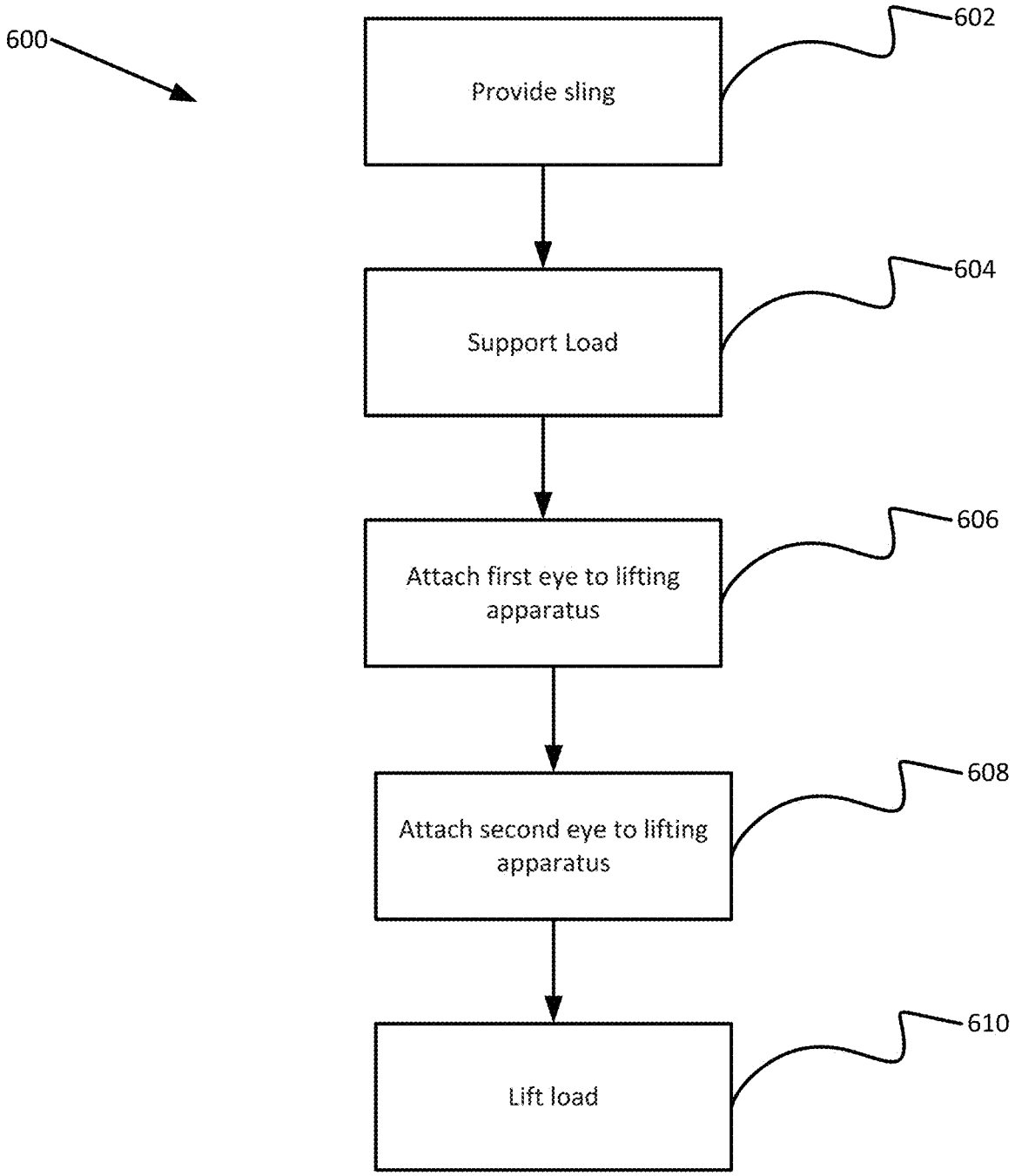
FIG. 7 is an example method for using a sling as shown in FIG. 3.

FIG. 7 shows an example method 600 for using a sling; however, other embodiments can include more or fewer operations. The method 600 begins by providing a sling (operation 602). Typically, the sling includes one or more aspects described above with reference to the sling 100 and to FIGS. 1-5.

For instance, the sling can include a sleeve, a first eye, and a second eye. The sleeve can include braided strands and have a first end portion, a second end portion, and an intermediate portion therebetween. The sleeve also defines a hollow inner volume. The first eye can be formed by a first splice with the first end portion extending into and along part of the hollow inner volume proximate the first eye. The second eye can be formed by a second splice with the second end portion extending into and along part of the hollow inner volume proximate the second eye. Additionally, a hollow load bearing portion is defined in the intermediate portion between the first splice and the second splice.

Next, a load to be lifted is supported with the load bearing portion of the sling (operation 604). Then the first eye is attached to a lifting apparatus (operation 606) and the second eye is attached to the lifting apparatus (operation 608). When the sling is supporting the load and the first and second eyes are attached to the lifting apparatus, the load is lifted (operation 610).

EXPERIMENTAL EXAMPLES

Exemplary embodiments were manufactured details are discussed below.

A. Example Sleeve and Sling

Figure 8:
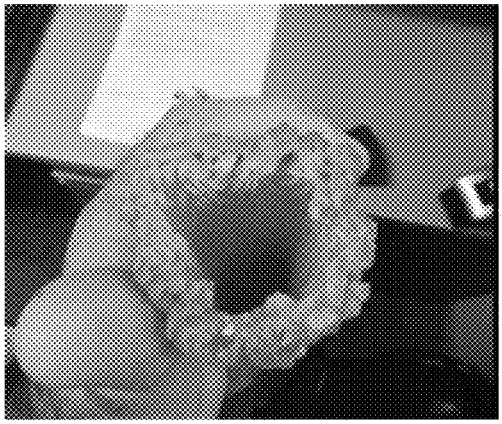
FIG. 8 is a photograph showing an exemplary sleeve.

FIG. 8 is a photograph of an example sleeve used to make an example sling. The sleeve shown in FIG. 8 has an overall length of 20 meters and includes braided strands in a 32×1 configuration. The sleeve shown in FIG. 8 includes a total denier of HMPE of 8,448,000 (32 carriers, 3 strands per carrier, where each strand is made of 55 ends of 1600 denier HMPE twisted together).

Figure 9:
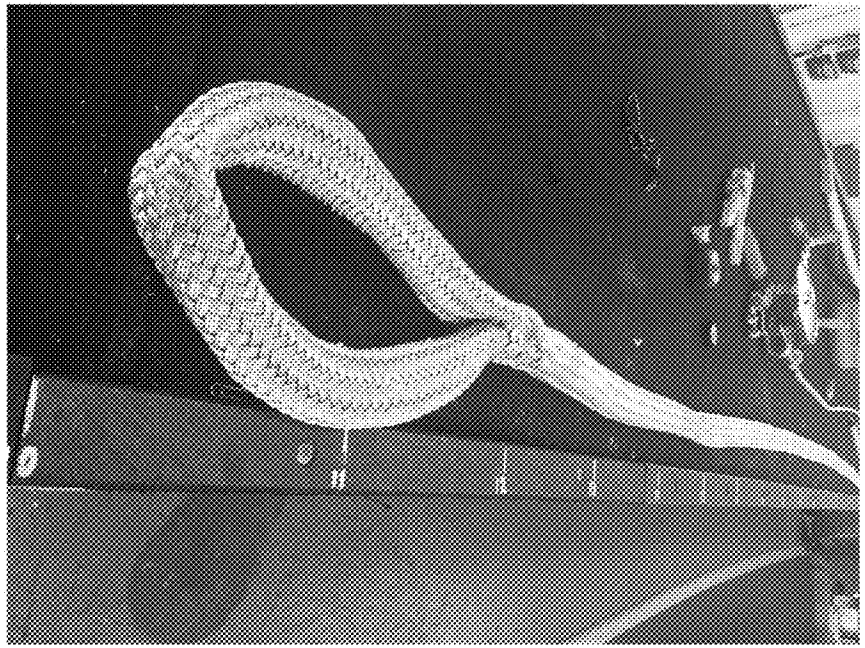
FIG. 9 is a photograph showing an exemplary sling cross section according to the principles of the sling of FIG. 1.

FIG. 9 is a photograph of a portion of an example sling manufactured from the example sleeve shown in FIG. 8. The first end portion and second end portion have a length of 23 times the sleeve diameter and the sleeve has a 20 m overall length. The first eye and second eye are 0.5 meters. The first splice and second splice are locking Brummel splices.

B. Break Test

Figure 10:
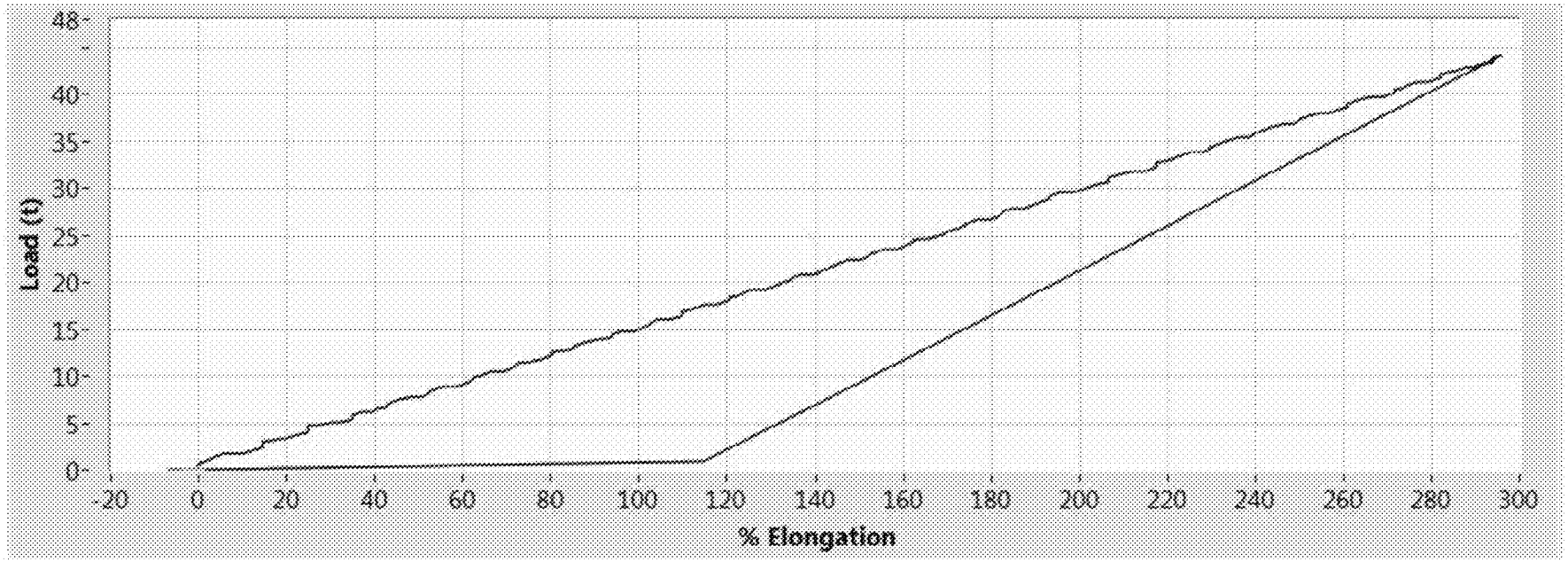
FIG. 10 is a line graph depicting the strength of a sling according to the principles of the sling of FIG. 1.

An example sling was constructed with a 32×3 configuration, having a diameter of 1.5 inches and including HMPE fibers having a total denier (material amount) of 35,328,000. Results of a break test are shown in FIG. 10, where the break test followed the CI-1500 test method as defined in a May 2015 publication by the Cordage Institute. The sling achieved 45 Te of breaking force while the flattened width over a pin was 2.75 inches under load.

For comparison, a strength member with a 12×1 or 12×2 configuration made with the same HMPE with a diameter of 1.125 inches, it is believed, would have a breaking force of about 65 Te and a flattened width over a pin of 1.69 inches under load. Regarding pressure, the example sling, it is believed, would exert 40% less pressure on the surface being lifted than the 12×1 or 12×2 strength member with breaking force of about 65 Te. When the example sling is compared to a 12×1 or 12×2 strength member with breaking force of about 45 Te, the example sling, it is believed, exerts 53% less pressure on the lifting surface.

It is to be understood that the instant disclosure is not limited in its application to the details of construction and the arrangement of components set forth in the following description or illustrated in the drawings. The disclosure is capable of other independent embodiments and of being practiced or of being carried out in various ways.

One or more independent features and/or independent advantages of the invention may be set forth in the claims.

What is claimed is:

1. A sling comprising:

a sleeve including braided strands and having a first end portion, a second end portion, and an intermediate portion therebetween, the sleeve defining a hollow inner volume;

a first eye formed by a first splice, the first splice including the first end portion extending into and along part of the hollow inner volume proximate the first eye; and a second eye formed by a second splice, the second splice including the second end portion extending into and along part of the hollow inner volume proximate the second eye;

wherein a hollow load bearing portion is defined in the intermediate portion between the first splice and the second splice; and wherein each of the first splice and the second splice include a locking Brummel splice.

2. The sling according to claim 1, wherein the braided strands are in a 24×3 configuration.

3. The sling according to claim 1, wherein the braided strands are in a 32×3 configuration.

4. The sling according to claim 3, wherein the sling has a total denier of high modulus polyethylene (HMPE) of about 35,328,000.

5. The sling according to claim 3, wherein the sling has a breaking force of about 45 Te when subjected to a CI-1500 test method as defined in a May 2015 publication by the Cordage Institute.

6. The sling according to claim 1, wherein the braided strands are in one of the following configurations: 12×3, 16×3, 20×2, 20×3, 24×1, 24×2, 24×3, 32×1, 32×2, 32×3, 48×1, 48×2, or 48×3.

7. The sling according to claim 1, wherein the first end portion has a length of 21 times a diameter of the sleeve, and said length extends into the hollow inner volume adjacent the first eye.

8. The sling according to claim 1, wherein the braided strands are made of high modulus polyethylene (HMPE) fibers, liquid crystal polymers, or aramid fibers.

9. The sling according to claim 8, wherein an outer surface of the HMPE fibers, the liquid crystal polymers, or the aramid fibers includes a polyurethane coating.

10. The sling according to claim 1, wherein the load bearing portion has a width and a diameter, and wherein the load bearing portion has a flattened width of about 1.5-2 times the diameter when under a load.

11. The sling according to claim 1, wherein the sling exerts about 40% to about 55% less pressure on a lifting surface as compared to a 12×1 rope without a hollow portion, and wherein the sling and the 12×1 rope have similar diameters and the same HMPE fibers.

12. A method for manufacturing a sling, the method comprising:

forming a hollow sleeve including braided strands, the hollow sleeve having a first end portion, a second end portion, and an intermediate portion therebetween, the sleeve defining a hollow inner volume;

forming a first eye by splicing the first end portion to extend into and along part of the hollow inner volume of the hollow sleeve; and forming a second eye by splicing the second end portion to extend into and along part of the hollow inner volume of the hollow sleeve wherein a hollow load bearing portion is formed in the intermediate portion between the first eye and the second eye.

13. The method according to claim 12, wherein forming the first eye includes using a Brummel splice technique; and wherein forming the second eye includes using the Brummel splice technique.

14. The method according to claim 13, wherein forming the first eye includes arranging the first end portion such that the first end portion of the sleeve extends into the hollow inner volume, the first end portion having a length of 21 times a diameter of the sleeve.

15. The method according to claim 14, wherein forming the second eye includes arranging the second end portion such that the second end portion of the sleeve extends into the hollow inner volume, the second end portion having a length of 21 times a diameter of the sleeve.

16. A method for using a sling, the method comprising:

providing the sling, the sling including a sleeve including braided strands and having a first end portion, a second end portion, and an intermediate portion therebetween, the sleeve defining a hollow inner volume, a first eye formed by a first splice with the first end portion extending into and along part of the hollow inner volume proximate the first eye, and a second eye formed by a second splice with the second end portion extending into and along part of the hollow inner volume proximate the second eye, wherein a hollow load bearing portion is defined in the intermediate portion between the first splice and the second splice;

supporting a load to be lifted with the load bearing portion, the load bearing portion being flattened on a surface of the load;

attaching the first eye to a lifting apparatus;

attaching the second eye to the lifting apparatus; and lifting the load with the sling.

* * * * *